US005531036A

United States Patent [19]

Shinkle

[11] Patent Number: 5,531,036

[45] Date of Patent: Jul. 2, 1996

[54] FORKLIFT VEHICLE PLOW ATTACHMENT

[75] Inventor: Carl W. Shinkle, Louisville, Ky.

[73] Assignee: FOR S Inc., Louisville, Ky.

[21] Appl. No.: 391,425

[22] Filed: Feb. 16, 1995

[51] Int. Cl.[6] ..... E02F 3/96

[52] U.S. Cl. ..... 37/405; 37/266; 37/468; 414/607

[58] Field of Search ..... 37/405, 468, 405, 37/409, 410, 266, 267, 268, 269, 270; 172/445, 817; 414/607, 713

[56] References Cited

U.S. PATENT DOCUMENTS

| | | | |
|---|---|---|---|
| 2,500,887 | 3/1950 | Trissler . | |
| 2,709,269 | 5/1955 | Williams | 15/52.1 |
| 3,010,230 | 11/1961 | Zubko | 37/236 X |
| 3,115,261 | 12/1963 | Antolini | 37/405 X |
| 3,484,964 | 12/1969 | Jeffery, Jr. . | |
| 3,512,665 | 5/1970 | Westendorf . | |
| 3,866,342 | 2/1975 | Cooper . | |
| 3,966,070 | 6/1976 | Barth | 414/713 |
| 4,085,856 | 4/1978 | Westendorf . | |
| 4,102,464 | 7/1978 | Schuster | 414/607 X |
| 4,242,035 | 12/1980 | Hornstein | 37/405 X |
| 4,303,507 | 12/1981 | Smith | 37/405 X |
| 4,357,766 | 11/1982 | Croteau et al. . | |
| 4,422,819 | 12/1983 | Guest | 414/607 X |
| 4,439,939 | 4/1984 | Blau | 37/235 X |
| 4,545,721 | 10/1985 | Pettersson | 414/607 X |
| 4,600,354 | 7/1986 | Niewald et al. | 414/607 |
| 4,666,360 | 5/1987 | Harms et al. | 414/607 |
| 4,929,145 | 5/1990 | Thompson | 414/607 |
| 5,031,343 | 7/1991 | Houle et al. . | |
| 5,154,241 | 10/1992 | Comer et al. . | |
| 5,221,176 | 6/1993 | Allen et al. | 414/607 X |
| 5,291,819 | 3/1994 | Hambric | 37/405 X |
| 5,366,339 | 11/1994 | Gould | 414/607 |

FOREIGN PATENT DOCUMENTS 1242996 10/1988 Canada .

OTHER PUBLICATIONS

"Little Giant Attachments" brochure No. 9388, Little Giant Products, Inc.

*Primary Examiner*—Terry Lee Melius
*Assistant Examiner*—Victor Batson
*Attorney, Agent, or Firm*—Wood, Herron & Evans

[57] ABSTRACT

A plow attachment for a forklift vehicle that has elongated cavities extending from the rearside of the scrapper blade to receive the lift arms of the forklift vehicle. A connecting link is used to hold the plow attachment on the lift arms, and the plow attachment includes adjustable elements that permit the plow attachment to be mounted on the lift arms at an angle.

14 Claims, 2 Drawing Sheets

FORKLIFT VEHICLE PLOW ATTACHMENT

FIELD OF THE INVENTION

The present invention relates generally to attachments for forklift vehicles, and more particularly, to a plow attachment for a forklift vehicle.

BACKGROUND OF THE INVENTION

There are numerous situations in which it is desirable to be able to scrape, push or move various materials, for example, sand, snow, gravel, dirt, etc. from one location to another. Plow attachments functioning as scraper blades are known which are attachable to trucks, tractors, front-end loaders, and other equipment. For purposes of this application, a plow attachment and scrapper blade attachment are considered synonymous. The prior art illustrates a great variety of plows, that is, scraper blades, which are attachable by various means to different vehicles. Further, the plow attachments of the prior art have substantial complexity in either mounting the plow attachments on the various vehicles or, in providing the plow with mechanisms for adjusting the scrapper blade to different elevations and angular orientations with respect to the vehicle. Further, the complexity of such plow attachments adds to their cost, reduces their reliability and makes them inappropriate for situations where there is only an occasional requirement for their use.

Even though the prior art contains numerous examples of combinations of plow attachments and different vehicles, an important combination is missing; and further, there are a great number of environments where the devices of the prior art are not practical. For example, many manufacturing facilities and warehouses, and especially smaller manufacturing facilities and warehouses, have only one type of vehicle, that is, a forklift truck or vehicle. Further, in the normal course of business of such facilities, it may be required to scrape snow from roadways, scrape sand onto roadways, or move other quantities of various materials, for example, gravel, dirt, etc. With the known prior art plow attachments, the forklift vehicle is not useful for performing such jobs; and that work must be subcontracted to others at significant cost and with significant time delays. Consequently, there is a significant disadvantage in the prior art in that there is no plow attachment for use with a forklift vehicle.

SUMMARY OF THE INVENTION

To overcome the disadvantages described above, the invention provides a plow, that is, a scraper blade, attachment for a forklift truck which is simple in its design and construction, easy to attach, and relatively inexpensive. The forklift vehicle plow attachment of the present invention is especially useful in those situations where no other powered vehicles are available, and where it is occasionally necessary to move or scrape from one location to another various materials, such as, for example, snow, sand, gravel, etc.

According to the principles of the present invention and in accordance with the described embodiments, the plow attachment includes a plow body having opposed front and rear sides. Two elongated cavities are attached to and extend longitudinally from the rear side of the plow body for receiving lift arms of the forklift vehicle. The invention further includes mechanical linkage between the plow body and the forklift vehicle to prevent the plow body from being moved off of the lift arms.

In a further embodiment of the invention, the elongated cavities have a rectangular cross section that is sized to receive and slide over the rectangular cross section of the lift arms. Further, the rectangular cross sections of the elongated cavities of the plow body have a longitudinal dimension that is greater than the longitudinal dimension of the rectangular cross section of the lift arms. Therefore, the plow body may be pivoted with respect to the lift arms through a predetermined angle, for example, 15°.

In further embodiments of the invention, the connecting element linking the plow body to the forklift vehicle may be either a flexible link, for example, a chain, or a rigid link, for example, a tie rod. Further, the connecting element may be a pin that extends through the elongated cavities and the lift arms thereby preventing the plow body from being moved off the lift arms. In a still further embodiment of the invention, the plow further includes a clamp operatively connected to the connecting element for selectively tightening and loosening the connecting element. Other embodiments of the invention include reinforcing members for providing greater rigidity to the plow attachment.

DETAILED DESCRIPTION OF THE INVENTION

Figure 1:
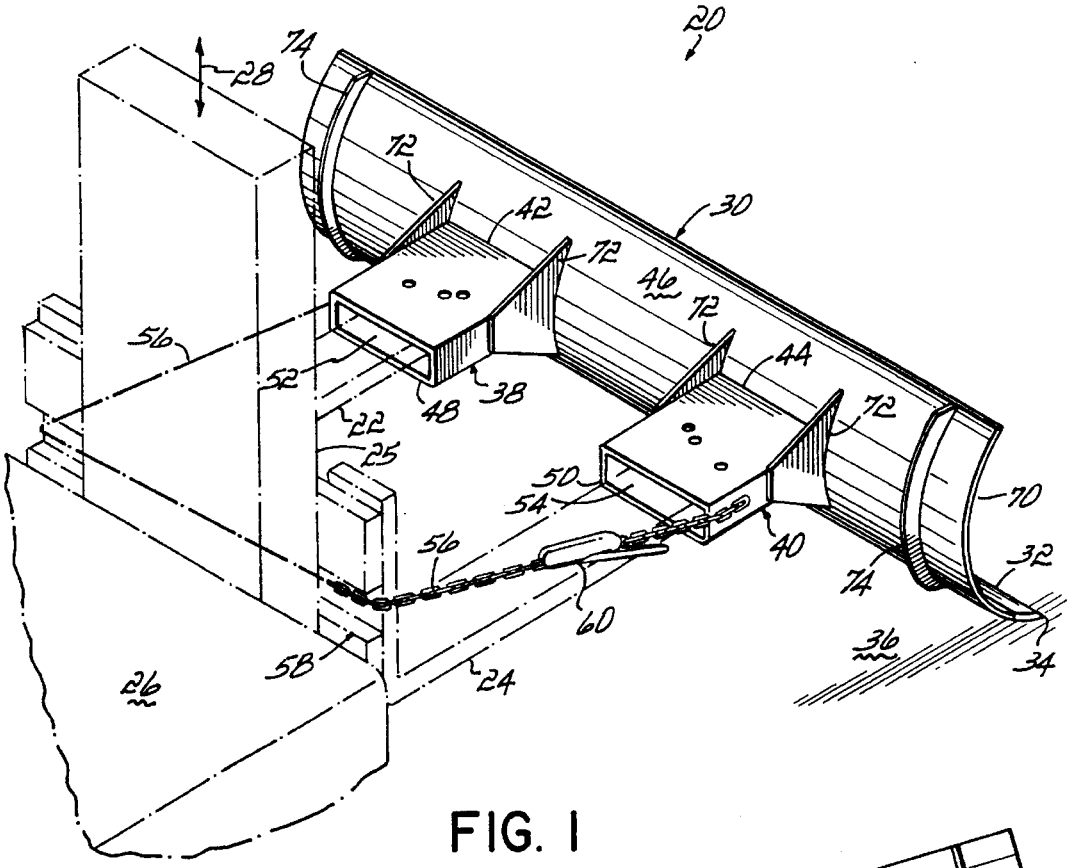
FIG. 1 is a perspective view illustrating the plow attachment for a forklift vehicle of the present invention.

Referring to FIG. 1 the plow attachment 20 is mounted on lift arms or forks 22, 24 (shown in phantom) which are operatively connected to a forklift truck or vehicle 26 (also shown in phantom). The lift arms 22, 24 extend substantially horizontally foward of a front side 25 of the forklift 26 and move in the generally vertical direction 28. The plow attachment 20 includes a plow body or scraper 30 which has a scraper blade 32 along and contiguous with a lower longitudinal edge 34 of the plow body 30. The blade 32 may be made from a harder material than the plow body 30 and therefore is adapted to slidingly contact a surface 36.

The plow body 30 includes first and second hollow support members 38, 40. The support members 38, 40 have respective first ends 42, 44 connected to a rear side 46 of the plow body 30. The first and second support members 38, 40 have respective open second ends 48, 50 and respective elongated cavities 52, 54 for receiving the lift arms 22, 24, respectively. The support members 38, 40 are positioned on the rear side 46 of the scraper 30 such that the support members 38, 40 extend longitudinally and outwardly from the rear side 46 of the plow body 30. A connecting element 56 mechanically holds the plow attachment 20 on the lift arms 22, 24. The connecting element 56 may be the illustrated chain which is connected, for example, by welding, at one end to the support member 40; and as shown in phantom, the chain 56 is wrapped around an element 58 of the forklift vehicle 26, and is connected at its other end, for example, by welding, to the support member 38. The chain is tightened by one or more chain clamps 60, for example, Lever Action Load Binders, Part No. 2968T4 found in the 1994 McMaster-Carr Catalogue.

Referring to FIGS. 1–4, the plow body 30 is formed from metal plate preferably a low carbon steel 0.120 inches thick and has a generally concave front side 70 formed to a radius of, for example, 11 inches. The support members 38, 40 are pieces of rectangular metal tubing, preferably, 0.250 inches thick, 2 inches in height, 12 inches in width, and 14 inches in length. The rectangular metal tubing members 38, 40 are welded to the rear surface 46 of the plow body 30. The rectangular tubing members 38, 40 are further supported on the plow body 30 by the gussets 72. Each of the gussets 72 is shaped to match and mate with the generally convex rear surface 46 of the plow body 30. The gussets 72 are generally triangularly shaped, have first sides welded to the longitudinal corners of the rectangular tubes 38, 40 and have second sides welded to the generally convex rear surface 46 of the plow body 30.

Figure 3:
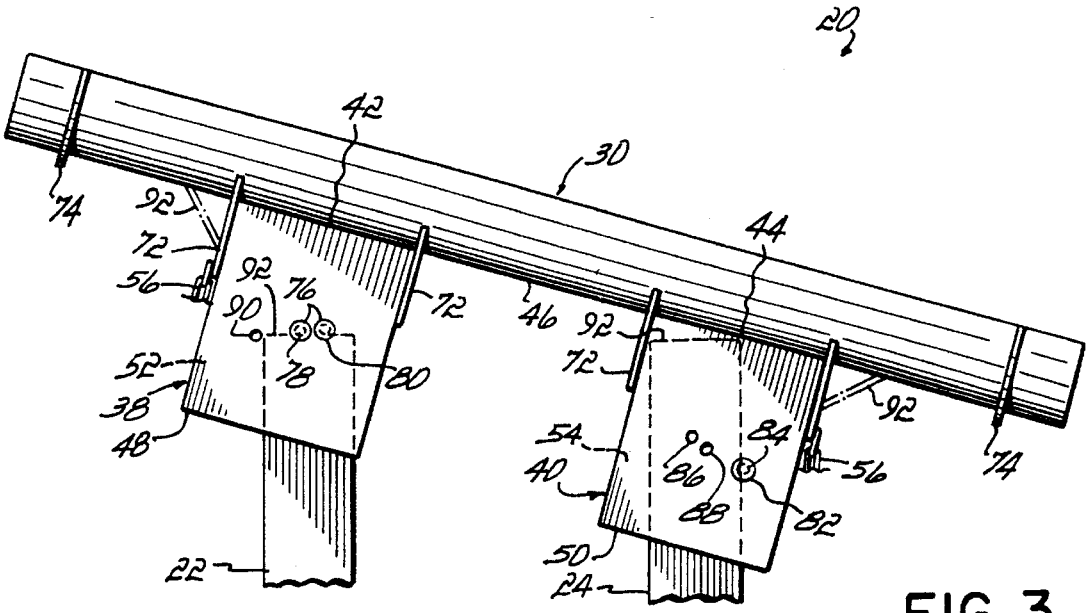
FIG. 3 is a top view showing the plow attachment skewed toward the right side of the vehicle.
Figure 4:
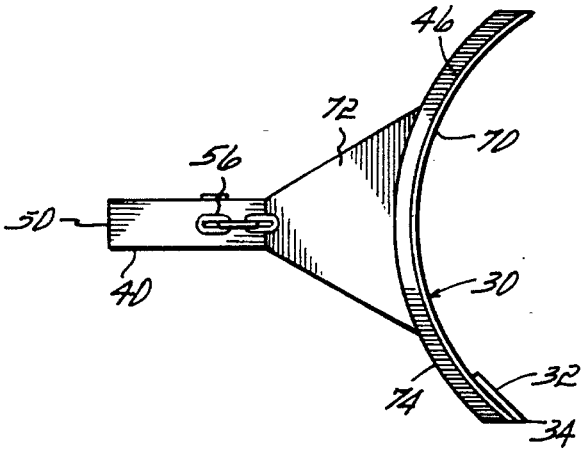
FIG. 4 is a side elevation of the plow attachment.

The scraper blade or edge 32 of FIG. 3 is formed by welding a piece of rectangular bar stock that is preferably 0.250 inches thick, 3.0 inches wide, and extends over the full length, preferably 6 feet, of the lower edge 34 of the plow body 30. The plow body 30 is further strengthened by ribs 74, which again are preferably made from 0.250 inch thick steel plate and welded to the rear surface 46 of the plow body 30.

Figure 2:
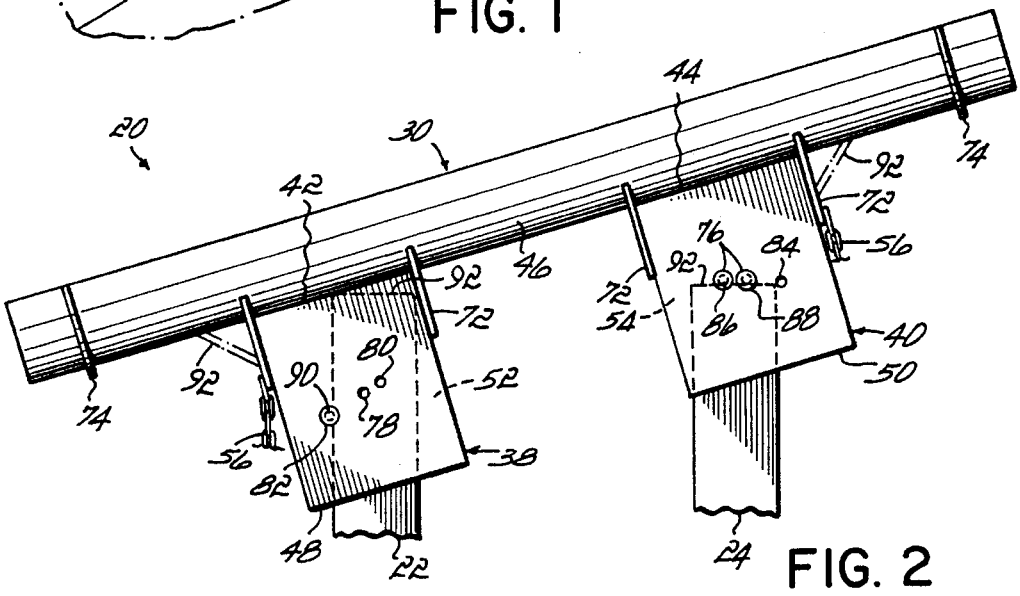
FIG. 2 is a top view showing the plow attachment skewed toward the left side of the vehicle.

As shown in FIG. 1, the plow attachment 20 may be mounted on the lift arms 22, 24 of the forklift vehicle 26 such that the longitudinal edge 34 of the plow attachment 20 is generally perpendicular to the longitudinal centerlines of the lift arms 22, 24. Referring to FIGS. 2 and 3, the plow attachment 20 also is designed to alternatively mount on the lift arms 22, 24 such that the longitudinal edge 34 forms an angle preferably in the range of from approximately 5° to approximately 25° with a line perpendicular to the length of the lift arms 22, 24, thereby selectively skewing the plow attachment 20 to the left or to the right. That angle is the same as the included oblique angle between the longitudinal centerlines of the lift arms 22, 24 and the cavities 52, 54. The generally rectangular cross-section of the cavities 52, 54 is sized to receive the generally rectangular cross-section of the lift arms 22, 24. However, the longitudinal dimension, that is, width, of the rectangular cross-section of the cavities 52, 54 is larger than the longitudinal dimension, that is, width, of the rectangular cross-section of the lift arms 22, 24. The angular limits through which the plow attachment can pivot are dependent on the widths of the lift arms 22, 24 and the cavities 52, 54. In the preferred embodiment, the lift arms are six inches wide and the cavities are almost twelve inches wide. The angular pivot or skew of the plow attachment on the lift arms is preferably 15°.

If it is desired to skew the plow attachment to the right as shown in FIG. 3, pins 76 are inserted in holes 78, 80. The pins 76 function as an element to limit, or block the penetration of the lift arm 22 into the rectangular tubing support member 38. In addition, pin 82 is inserted in hole 84 to limit or block sideward motion of the lift arm 24 in the cavity 54 of the rectangular tubular support 40, that is, to prevent the lift arm 24 from moving in a direction corresponding to the longitudinal direction of the rectangular cross-section of the lift arm 24. To skew the plow blade to the left as shown in FIG. 2, the pins 76 shown are inserted in holes 86, 88 and the pin 82 is inserted in hole 90. In that configuration, the lift arm 22 is fully inserted into the cavity 52 of the rectangular tube support 38 and is blocked from sideward movement by the pin 82. Further, the lift arm 24 is inserted part way into the cavity 54 of the rectangular tube member 40 and is blocked from further penetration by the pins 76 inserted through the holes 86, 88.

In use, when it is desired to plow, scrape, or move material, for example, gravel, sand, dirt, etc., pins 76, 82 are either, not used, or inserted in holes 78, 80, 84, or 86, 88, 90 depending on the desired angle of the plow body 30 with respect to the lift arms 22, 24. For example, for a perpendicular relationship, no pins are inserted in the holes in the support members. For a leftward inclination, pins 76, 82 are inserted in holes 86, 88, 90; and for a rightward orientation of the plow body 30, pins 76, 82 are inserted in holes 78, 80, 84. Preferably, the plow attachment is stored off of the fork lift truck with support blocks under the member 38, 40 to support those members in a generally horizontal plane, thereby facilitating mounting of the plow attachment on the forklift. However, the plow attachment may be stored with the ends 48, 50 of the members 38, 40 resting on the ground. In any event, the operator of the forklift vehicle 26 then lowers the lift arms, or forks to a height or elevation which is the same as the cavities 52, 54 of the support members 38, 40. The forklift vehicle operator then moves the forklift vehicle toward the stationary plow attachment 20 inserts the distal ends 92 of the lift arms 22, 24 into the open ends 48, 50 of the respective support members 38, 40. The operator then raises the lift arms 22, 24 until the longitudinal cavities 52, 54 are generally in the same horizontal plane as the lift arms 22, 24. The operator then moves the forklift vehicle forward to insert the forks, or lift arms 38, 40 into the cavities 52, 54, respectively to support the plow attachment 20 on the distal ends 92 of the lift arms 38, 40 substantially forward of the front side 25 of the forklift 26.

Alternatively, after support members 38, 40 are approximately coplanar with the fork arms, 22, 24, the connecting link or chain 56 is then looped around the lift arm support 58 or some other convenient structural member of the forklift vehicle 26; and the one or more chain tightening mechanisms 60 are used to pull the plow attachment 20 onto the lift arms 22, 24. The chain tightening mechanisms 60 are further used to tightly secure the plow attachment 20 on the forklift vehicle 26, so that the lift arms 22, 24 bear against either the rear surface 46 of the plow body 30 or the pins 76. In either event, the chain tightening devices 60 are operated to tighten the chain 56 and secure the plow attachment 20 onto the distal ends 92 of the lift arms 22, 24.

Figure 5:
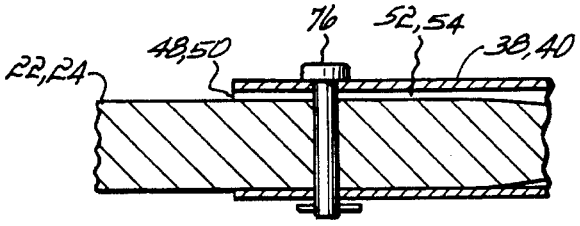
FIG. 5 is a cross-sectional view depicting an alternative embodiment of the invention.

While the invention has been set forth by a description of the embodiment in considerable detail, it is not intended to restrict or in any limit the claims to such detail. Additional advantages and modifications will readily appear to those who are skilled in the art. For example, the connecting link or chain 56 may have a hook or clasp-type link on its ends which may be attached to a loop 94 shown in phantom in FIG. 2. The connecting element 56 may be a chain, ratchet straps, winch straps or other general utility straps, webbing, or tie downs. The connecting element 56 may be terminated by hooks, clasps or even magnets which attach its ends to the plow attachment and/or the forklift truck. The connecting element 56 may be tightened by either lever action, ratchet action, spring action or take-up load binders such as are well known and commercially available. For example, a "PONY" band clamp commercially available from Adjustable Clamp Company of Chicago, Ill. may also be used. Therefore, the connecting element 56 may be any type of connector which functions to hold the plow attachment onto the lift arms. Instead of being linked around the support member 58, the chain 56 may be two pieces, each piece extending from one of the support members 38, 40 to a point on the forklift vehicle 26. In a further alternative as shown in FIG. 5, the chain may be replaced by mounting pins 76 which extend through the support members 38, 40 and through matching holes in the lift arms 22, 24. Consequently, the plow attachment of the present invention is not limited by the particular mechanism by which the plow attachment 20 is held in place on the lift arms 22, 24.

Similarly, the mechanism by which the plow attachment 20 is mounted at an angle on the lift arms 22, 24 may be varied. For example, the support members 38, 40 may be drilled with only one set of holes, such as the set 78, 80, 82, and the plow body may be manufactured with a scraping edge 32 on both the upper and the lower longitudinal edges. Therefore, in that embodiment, the rightward or leftward orientation of the plow attachment may be obtained by mounting the plow with one scraper edge pointed downward or alternatively inverting the plow so that the opposing scraper edge is the downward edge. In a further embodiment, the angular adjustment may be obtained by rigidly mounting rectangular tongues on the rear side 46 of the plow body 30 which are sized similarly to the size of the lift arms 22, 24. The rectangular tubing members 38, 40 are not welded in place on the rear side 46 of the plow body 30, but instead hole patterns are drilled through the support members 38, 40 and the tongues such that the support members 38, 40 may be mounted at different orientations on the tongues by inserting pins through the drilled holes. Once again the invention is not limited by the particular mechanism utilized to mount the plow attachment 20 a predetermined angle. Accordingly, departures may be made from the details described herein without departing from the spirit and scope of the invention.

What is claimed is:

1. A plow attachment for a forklift vehicle with two lift arms, each of the two lift arms having a first generally rectangular cross-section with a first longitudinal dimension, the plow attachment comprising:

a plow body having
- a front side being curved about an axis forward of the front side of the plow body, and
- a rear side generally opposite the front side;

a pair of hollow support members having
- first ends connected to the rear side of the plow body,
- second ends opposite the first ends and extending from the rear side of the plow body, and
- cavities intersecting the second ends of the support members, each of the cavities having a second generally rectangular cross-section with a second longitudinal dimension substantially greater than the first longitudinal dimension, the cavities receiving and sliding over the, lift arms of the forklift vehicle to support the plow attachment on the two lift arms a blocking member extending through a hole in one of the pair of hollow members intermediate its respective first and second ends to limit penetration of a lift arm into a respective cavity; and a connecting element mechanically linking the plow body to the forklift vehicle for holding the plow body on the two lift arms.

2. The plow attachment of claim 1 wherein the second generally rectangular cross-sections of the elongated cavities each has a longitudinal dimension greater than a respective predetermined longitudinal dimension of the first generally rectangular cross-sections of the two lift arms, thereby permitting the plow attachment to pivot on the lift arms through an included angle in a range of from approximately 5° to approximately 25° between longitudinal centerlines of the lift arms and longitudinal centerlines of the elongated cavities.

3. The plow attachment of claim 2 wherein the included angle is approximately 15°.

4. The plow attachment of claim 2 wherein another of the pair of hollow support members has a member for limiting sideward motion of one of the two lift arms in the longitudinal direction of the second generally rectangular cross-section of the cavity of the other of the pair of hollow support members.

5. The plow attachment of claim 4 wherein the other of the pair of hollow members has a hole intermediate the first and second ends for receiving a blocking member to limit sidewards motion of one of the two lift arms in the longitudinal direction of the second generally rectangular cross-section of the cavity of the other of the pair of hollow support members.

6. The plow attachment of claim 1 wherein the connecting element is a flexible link extending between the plow body and the fork lift vehicle, thereby preventing the plow body from being moved off of the lift arms.

7. The plow attachment of claim 6 wherein the flexible link is a chain.

8. The plow attachment of claim 1 wherein the connecting element is a rigid link extending between the plow body and the fork lift vehicle, thereby preventing the plow body from being moved off of the two lift arms.

9. The plow attachment of claim 8 wherein the rigid link is a tie rod.

10. The plow attachment of claim 1 wherein at least one of the pair of support members has a first hole extending therethrough and at least one of the two lift arms has a mating second hole extending therethrough and the connecting element is at least one pin extending through the first hole and the mating second hole, thereby preventing the plow body from being moved off of the two lift arms.

11. The plow attachment of claim 1 further comprising a clamp operatively connected to the connecting link for selectively tightening and loosening the connecting element.

12. A plow attachment for a forklift vehicle with two lift arms extending generally horizontally from the forklift vehicle, each of the two lift arms having a first generally rectangular cross-section with a first longitudinal dimension, the plow attachment comprising:

a generally rectangular plow body having
- a front side being curved about an axis substantially parallel to a longitudinal centerline of the plow body and forward of the front side,
- a rear side opposite the front side, and
- a blade extending along a lower longitudinal edge of the plow body and adapted to slidingly contact a surface;

a pair of hollow rectangular mounting members, each of the mounting members having
- a first end connected to the rear side of the plow body to direct a longitudinal centerline of the mounting member outwardly away from the rear side of the plow body,
- an open second end opposite the first end for receiving one of the two lift arms of a forklift vehicle, and
- a rectangular cavity extending between the first end and the open second end and having a second generally rectangular cross-section with a second longitudinal dimension substantially greater than the first longitudinal dimension, the cavity receiving and sliding over the one of the lift arms of the forklift vehicle for mounting the plow attachment on the lift arms and bringing the blade into contact with the surface;

a blocking member extending through a hole intermediate the first and the Second ends of one of the pair of hollow members to limit penetration of a lift arm into a respective cavity; and a tie connected between the plow body and the forklift vehicle for restraining the plow body from being moved off of the two lift arms.

13. The plow attachment of claim 12 wherein the rear side of the plow body is generally convex.

14. The plow attachment of claim 13 wherein the longitudinal centerline of each of the mounting members extends in a direction generally normal to the rear side.

* * * * *